United States Patent [19]

Landon et al.

[11] 4,393,769

[45] Jul. 19, 1983

[54] ELECTROSTATIC CLUTCH-OPERATED PRINTING MECHANISM

[75] Inventors: Alfred J. Landon, Peekskill; William B. Pennebaker, Carmel; Han C. Wang, Chappaqua, all of N.Y.

[73] Assignee: International Business Machines Corporation, Armonk, N.Y.

[21] Appl. No.: 221,864

[22] Filed: Dec. 31, 1980

[51] Int. Cl.[3] ..... B41J 9/10; B41J 9/32; B41J 9/36

[52] U.S. Cl. ..... 101/93.3; 101/93.31; 101/93.48; 192/84 E

[58] Field of Search ..... 101/93.29, 93.3, 93.31, 101/93.23, 93.48, 93.28, DIG. 13, 93.19, 93.02, 93.32–93.36; 192/84 E

[56] References Cited

U.S. PATENT DOCUMENTS

| | | | |
|---|---|---|---|
| 2,850,907 | 9/1958 | Foster | 192/84 E |
| 2,850,908 | 9/1958 | Foster | 192/84 E |
| 2,909,996 | 10/1959 | Fitch | 101/93.23 X |
| 2,916,920 | 12/1959 | Planer et al. | 192/84 E X |
| 3,002,596 | 10/1961 | Fitch | 192/84 E |
| 3,199,650 | 10/1965 | Brown et al. | 101/93.19 X |
| 3,655,019 | 4/1972 | Trzaska | 101/93.31 X |
| 3,804,009 | 4/1974 | Blume | 101/93.02 X |
| 3,878,778 | 4/1975 | Gromi | 101/93.29 |

FOREIGN PATENT DOCUMENTS

| | | | |
|---|---|---|---|
| 2063830 | 7/1971 | Fed. Rep. of Germany | 101/93.48 |
| 2203354 | 8/1973 | Fed. Rep. of Germany | 101/93.48 |
| 1430312 | 3/1976 | United Kingdom | 101/93.48 |

*Primary Examiner*—Edgar S. Burr
*Assistant Examiner*—Moshe I. Cohen
*Attorney, Agent, or Firm*—Scully, Scott, Murphy & Presser

[57] ABSTRACT

An impact printing mechanism is disclosed having an electrostatic clutch assembly, including a rotatively mounted semiconductive coated drum and a conductive band wrapped around the circumference thereof. The printing mechanism includes a printing hammer and a print spring for actuating the printing hammer. When a print command is issued, a voltage is applied to the band to create a field between the band and the drum coating. An electrostatic force is therefore generated when the drum is rotating slowly or synchronous with the drum step motion. That motion will pull the band and compress the print spring. The potential energy stored in the spring is then ready to fire the hammer. A hammer firing command turns off the voltage pulse and discharges the field, releasing the electrostatic holding force instantaneously and firing the hammer by the compressed spring.

2 Claims, 4 Drawing Figures

ELECTROSTATIC CLUTCH-OPERATED PRINTING MECHANISM

BACKGROUND OF THE INVENTION

1. Field of the Invention

The present invention relates generally to a printing mechanism having a unique motion transmitter, and more particularly pertains to a printing mechanism adapted to be powered or actuated with a reciprocating movement by a continuously rotatable driving drum.

2. Discussion of the Prior Art

In greater detail, the subject invention is concerned with the operation of a motion transmitter in which an electrically conductive band is positioned around a rotatable driving drum, and is movable lengthwise by the rotating drum because of an electrostatic force generated between the band and the rotating drum by the application of a voltage pulse therebetween. A motion transmitter of this nature utilizes the well-known Johnsen-Rahbek effect, the theoretical and practical considerations of which are carefully considered in a paper by Ms. Stuckes under the title "Some Theoretical and Practical Considerations of the Johnsen-Rahbek Effect," Proceedings I. E. E. E., Vol. 103, Part B, No. 8, March 1956, pages 125 to 131. As a result of tests described in this paper, the conclusion was reached that an electrostatic motion transmitter involving a continuously rotatable driving member is not a practical arrangement, particularly because of the existence of problems in the areas of wear and heat generation, to which no adequate solution was foreseen.

The aforesaid problems have been overcome to a limited degree in several printing mechanisms proposed by the prior art. Previous designs for printing mechanisms using an electrostatic clutch principle based on the Johnsen-Rahbek effect have been operated in an active mode in which the clutch drives a print hammer to perform the printing operation during the electrostatic field charging portion of the cycle. A typical printing mechanism of this type utilizes a semiconductive coated drum rotated at a high speed and a steel band wrapped around the drum. One end of the band is attached to a spring, and the other end is secured to a print hammer. When a voltage pulse is applied to the steel band, the resultant electrical field generates an electrostatic force which holds the band against the drum. Rotation of the drum then carries the band and the hammer forward to perform a printing operation. Accordingly in these prior art printers, printing is accomplished when the clutch is initially electrostatically energized. During the idling portion of the cycle, the band slides continuously over the surface of the rotating drum. In these known mechanisms printing energy requirements have dictated that the hammer be actuated at a high speed, which in turn requires the drum to be rotated at a high speed. A typical drum circumferential speed is of the order of 150 inches per second. Accordingly the band constantly rubs or slides against the drum with a relatively high velocity, which results in rather severe wear conditions for the semiconductive coating on the drum and the encompassing band. Additionally a large initial tension on the band is required to maintain the band in good contact with the drum while it is rotating at high speeds, which again increases the resultant wear of the surfaces.

Foster U.S. Pat. No. 2,850,907, Foster U.S. Pat. No. 2,850,908 and Planer et al. U.S. Pat. No. 2,916,920 are illustrative of the aforementioned designs for printing mechanisms, and each has followed a slightly different approach to limiting wear problems therein.

Foster U.S. Pat. No. 2,850,907 discloses a motion transmitter for a printing mechanism having a continuously operable driving drum and a driven band member supported for relative movement along with the driving member, each having an electrically conductive face arranged to engage opposite sides of an intermediate member extending therebetween. The intermediate member is selected to have a dielectric constant and thickness such that energization of the printer by a current with a constant peak value causes clutching of the driven member to the driving member. The driven member is released from the driving member upon de-energization of the circuit by a shunt circuit connected across the conductive faces.

Foster U.S. Pat. No. 2,850,908 provides a motion transmitter for a printing mechanism having an electrically conductive band looped around a continuously rotatable driving member and in which an intermediate element is engaged and carried by the driving member for rotation therewith. The intermediate member has a pivoted lever with arms of unequal length disposed on opposite sides of the pivot, and the ends of the band are connected to each of the arms. Upon lengthwise movement of the band by the driving member, tension in the band portion connection to the shorter arm of the lever is relieved, thereby minimizing wear and heating at a position at which maximum friction would normally occur between the band and the intermediate element.

Planer et al. U.S. Pat. No. 2,916,920 illustrates a motion transmitter for a printing mechanism in which an electrically conductive band is looped around a continuously rotatable driving member, and in which an intermediate member is engaged by the band. An electrostatic force is developed between the band and the intermediate member, and is developed on a low friction track rotatable relative to the band. This produces a force in the band which is tangentially applied to a high friction track, also rotatable relative to the band, whereby the load applied to the band during a printing operation is accommodated by the high friction track.

In general, these prior art arrangements have still resulted in excessive wear of the relatively movable surfaces of the electrostatic printing mechanism.

SUMMARY OF THE INVENTION

Accordingly, it is a primary object of the present invention to provide an electrostatic impact printing mechanism of the aforementioned type which results in a substantial reduction of wear in the relatively moving components, including the rotating drum and the encompassing band, and which also improves the contact relationship between the relatively movable surfaces.

A further object of the subject invention is the provision of an electrostatic printing mechanism and its method of operation in which the flight time of the printing hammer remains substantially constant regardless of variations in friction and also in the pulse width of the actuating voltage pulse, and also of variations in mechanical tolerances caused by wear, etc. These beneficial advantages and results are achieved by actuating the printing hammer during discharge of the electrostatic field, rather than during the charging portion thereof.

In accordance with the teachings herein, the present invention provides an electrostatic printing mechanism in which the aforementioned objects are accomplished by rotating the drum at a relatively slow speed or by incrementally rotating it in steps, such as by a stepper motor or a DC motor. The printing mechanism includes a printing hammer and a print spring for actuating the printing hammer. When a print command is issued, a voltage is applied to the band to create a field between the band and the drum coating. An electrostatic force is therefore generated when the drum is rotating slowly or synchronous with the drum step motion. That motion will pull the band and compress the print spring. The potential energy stored in the spring is then ready to fire the hammer. A hammer firing command turns off the voltage pulse and discharges the field, releasing the electrostatic holding force instantaneously and firing the hammer by the compressed spring.

In operation of the present invention, the hammer is driven against a back stop or the spring is allowed to bottom out, which results in the band slipping on the drum surface after a predetermined amount of energy is stored in the spring. In this arrangement the amount of stored energy for the printing operation may be varied simply by adjusting the spring. Furthermore, the energy for the printing operation is stored in a compressed spring during the printer carriage incrementing period, which is a much longer time period than the hammer flight time. Accordingly, the driving drum can be rotated at a much lower speed or can be stopped during the idling portion of the cycle after the drum is incrementally rotated. The lower rotational speed and/or the limitation of the time of rotation of the drum results in a substantial reduction in wear for the relatively moving components.

In the aforementioned arrangement, a spring may be compressed with a 0.05 inch displacement by a drum rotating with a surface speed of only 10 inches per second, which compares extremely favorably with a typical prior art surface speed of 150 inches per second. Moreover, the response time of the printing hammer is extremely fast since the discharge time of the electrostatic field is almost instantaneous. Further the flight time of the printing hammer is maintained substantially constant despite variations in friction, the pulse width of the actuating voltage pulse, and also in mechanical tolerances caused by wear, etc.

In accordance with a preferred embodiment of the present invention, an impact printing mechanism is disclosed having an electrostatic clutch assembly, including a rotatively mounted semiconductive drum and a conductive band wrapped around the circumference thereof. The printing mechanism includes a printing hammer and a spring for actuating the printing hammer. The printing hammer is rotationally mounted on a hammer shaft, and has a first arm extending from the hammer shaft with a hammer head mounted thereon. The hammer head causes a printing operation during rotational movement of the printing hammer about the shaft in a first direction, and the spring compressively bears against the first arm during rotation thereof in a direction counter to the first direction. The printing hammer also has a second arm extending from the hammer shaft in a direction substantially opposite to that of the first arm. The second arm defines an elongated slot along its length, and a pin is mounted in the slot and is coupled to the band for movement therewith.

Moreover, in some embodiments of the present invention the printing mechanism include a plurality of printing hammers mounted side by side along the hammer shaft with each printing hammer having a separate band and spring.

BRIEF DESCRIPTION OF THE DRAWINGS

The foregoing objects and advantages of the present invention for an electrostatic clutch operated printer may be more readily understood by one skilled in the art with references being had to the following detailed description of several preferred embodiments thereof, taken in conjunction with the accompanying drawings wherein like elements are designated by identical reference numerals throughout the several drawings, and in which.

DETAILED DESCRIPTION OF THE DRAWINGS

Figure 1:
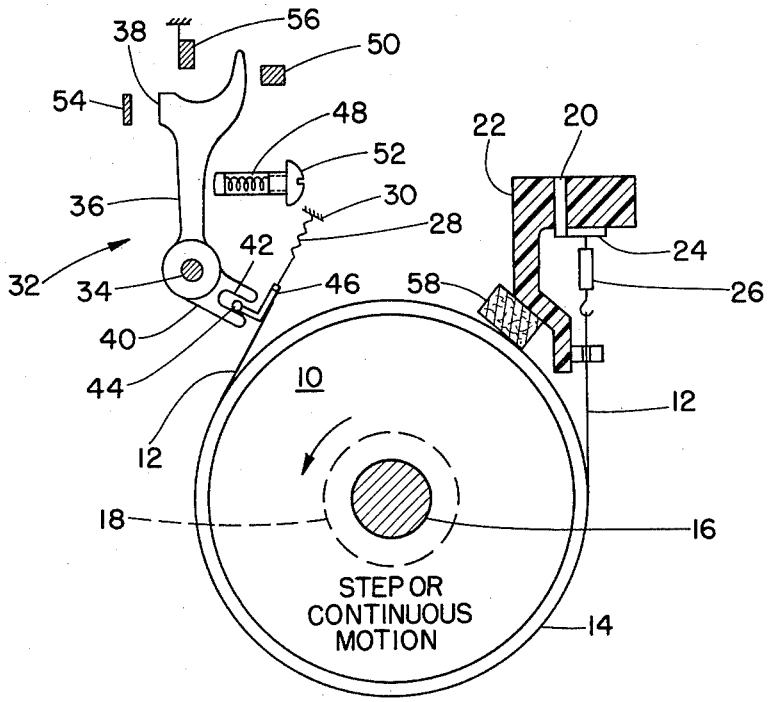
FIG. 1 ia an elevational view of an exemplary embodiment of a clutch operated printing mechanism constructed pursuant to the teachings of the present invention.

Referring to the drawings in detail, FIG. 1 is an elevational view of a schematically illustrated printing mechanism having an electrostatic clutch assembly which includes a rotatively mounted drum 10 having a conductive steel band 12 wrapped around the circumference thereof. The drum 10 is constructed from a conductive material such as aluminum, and is coated with a semiconductive coating 14 on the outer periphery thereof. The drum 10 is mounted for rotational movement about a shaft 16, and is driven by a motor 18 in a manner which is described in greater detail below.

In accordance with the well known Johnsen-Rahbek effect, a voltage pulse applied across the drum 10 and band 12 generates an electrostatic force which attracts the components together, thereby forming a clutch. Typically the shaft 16 is grounded, and a conductor 20 mounted in an insulated housing 22 leads via further conductive elements 24, 26 to one end of the steel band 12. Conductive element 26 is typically a spring mounted in tension to apply a tensile force to the band 12 to force it into a contact relationship with the outer peripheral surface of drum 10. The second end of the band 12 is secured by a second spring 28 to a mechanical fixture 30 which is electrically insulated. The tensile force maintained on band 12 may be in the range of from 50 and 100 grams tension.

A printing hammer 32 is rotatably mounted about a hammer shaft 34, and is constructed with a first arm 36, having a hammer head 38 thereon, extending from the hammer shaft. A second arm 40 extends from the shaft 34 in a direction substantially opposite that of the first arm, and defines an elongated slot 42 along its length. A pin 44 is mounted in the elongated slot, and is coupled via an L shaped dielectric arm 46 to the band 12 for longitudinal movement therewith upon actuation or deactuation of the electrostatic clutch. A spring 48 is mounted adjacent the first arm 36 of the hammer such that, during actuation of the electrostatic clutch, the printing hammer 32 rotates about shaft 34 in a clockwise direction to cock the spring 48 in compression. The hammer may be driven against a mechanical stop 50, or may be arranged to bottom out the spring 48, after which the band slips relative to the rotating drum surface such that the spring stores a predetermined amount of potential energy therein. An adjustment screw 52 may be provided such that the amount of stored energy for the printing operation may be varied simply by adjustment thereof.

Termination of the electrostatic field in the clutch assembly at the trailing edge of an actuating voltage pulse applied thereto causes the holding force on the spring 48 to be released in a substantially instantaneous manner such that the printing hammer 32 is fired in a counterclockwise direction by the compressed spring. In a typical printer, the printing hammer strikes against a printing element 54 such as a band or wheel or other known type of impact printing element. A mechanical stop 56 may be provided to limit the forward movement of the printing hammer 32. A brush 58 may be mounted on dielectric housing 22, and is provided to clean the surface of the rotating drum such that the electrostatic clutch mechanism operates in a satisfactory manner.

Shaft 16 is arranged to be driven at one end by motor 18 at a relatively slow speed, for instance with the arrangement being such that a surface speed of the rotating drum is achieved in the range of from 10 to 20 inches per second. The shaft may alternatively be driven incrementally by a motor such as a stepping motor or a DC motor having voltage pulses applied thereto. A preferred embodiment of the present invention includes a small continuously operated motor, utilizing the inertia developed by the motor and drum for the printing energy requirements, rather than a stepping motor which would require a comparatively larger motor.

Figure 2:
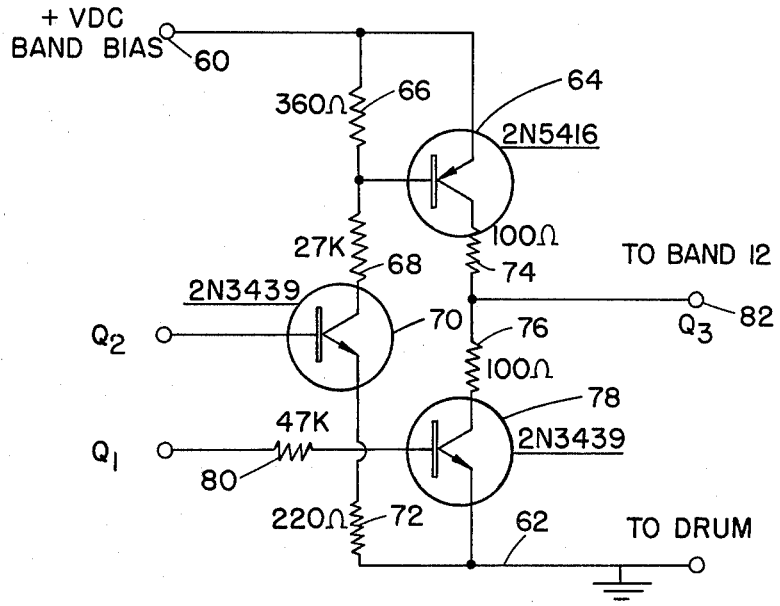
FIG. 2 illustrates a schematic of a clutch band driver circuit which may be utilized to generate the driving voltage pulse required to actuate the printer of FIG. 1.

FIG. 2 illustrates a schematic of a clutch band driver circuit which may be utilized to generate the driving voltage pulses required to actuate the electrostatic clutch assembly of FIG. 1. This is a well known type of circuit, and includes a source of DC voltage applied to a terminal 60 and a ground coupled to lead 62 and the drum 10. The DC voltage is coupled directly to the emitter of a PNP 2N5416 transistor 64. The voltage is applied through a resistor voltage divider circuit, including series coupled resistors 66 and 68, the latter of which is connected to the collector of an NPN 2N3439 transistor. The base of transistor 64 is coupled between resistors 66 and 68, and the base of transistor 70 is coupled directly to the $Q_2$ output of a monostable multivibrator. The emitter of transistor 70 is coupled to ground through a resistor 72. The collector of transistor 64 is coupled through a further resistor voltage divider network, consisting of series coupled resistors 74 and 76, and the voltage applied to the conductive steel band 12 is the voltage between the latter two resistors at terminal 82. The resistor 76 is in turn coupled to the collector of a further NPN 2N3439 transistor 78, with the emitter of that transistor being coupled to ground. The base of this last transistor is connected to the $\overline{Q}$ or $Q_1$ output of the aforementioned monostable multivibrator through an input coupling resistor 80.

Figure 3:
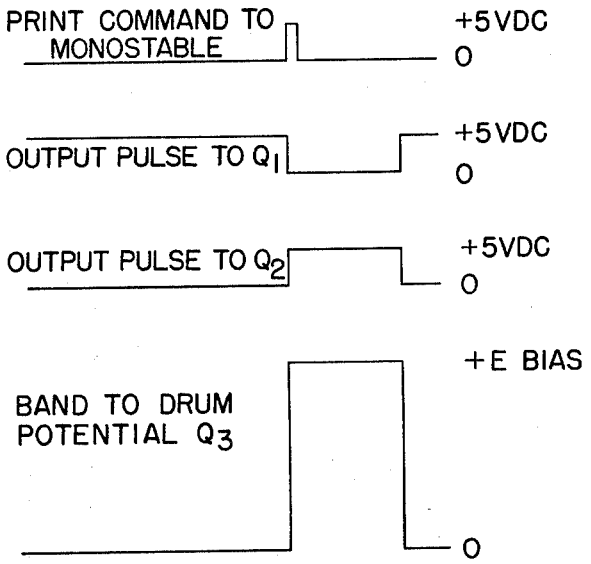
FIG. 3 illustrates several waveforms which are useful in explaining the operation of the circuit of FIG. 2.

In operation, at the initiation of the circuit, prior to the application of the pulses illustrated in FIG. 3, transistors 64 and 70 are in a non-conductive state, and transistor 78 is conducting. Upon the application of a timing pulse (for the print command signal) to a monostable multivibrator, the latter circuit generates a pulse Q designated $Q_2$ and a $\overline{Q}$ pulse designated $Q_1$. The application of these pulses to the bases of transistors 70 and 78 in the circuit of FIG. 2 results in a reversal of the conductive states, and transistors 64 and 70 are turned conductive while transistor 78 becomes non-conductive. This results in the application of a voltage pulse at terminal 82 to the conductive band 12 which causes actuation of the electrostatic clutch assembly and cocking of the compressive spring 48. Upon the termination of pulses $Q_1$ and $Q_2$, at the trailing edges thereof, the electrostatic clutch assembly is released in a fairly instantaneous manner to release the compressed spring, thereby actuating the printing hammer to perform a printing operation.

Figure 4:
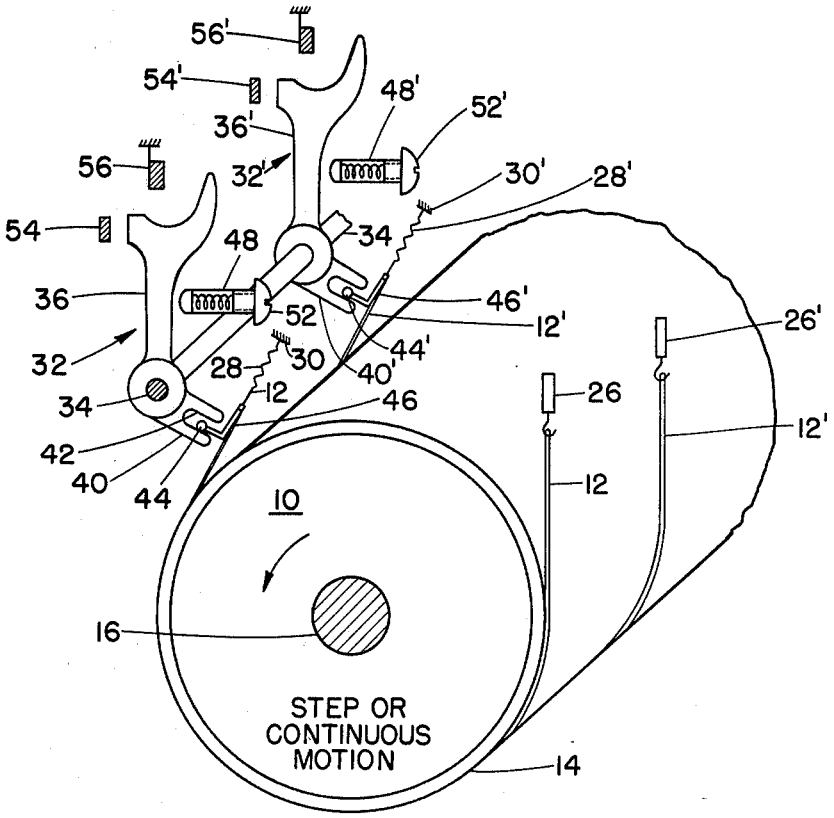
FIG. 4 is a schematic illustration of a second embodiment of a clutch operated printing mechanism, similar to that of FIG. 1, but having additional printing hammers.

FIG. 4 is a schematic illustration of a clutch operated printing mechanism similar to that of FIG. 1 but showing an additional printing hammer 32' mounted on shaft 26. All of this structure is substantially similar to the printing hammer and the components for the actuation thereof, as illustrated with respect to FIG. 1. Some of the structure illustrated in FIG. 1 is omitted from this view for the sake of clarity, but this embodiment would also include all of the omitted structure necessary for operation. The printing hammers 32 and 32' are illustrated as being spaced apart a substantial distance for the sake of clarity in the drawing, but in an actual embodiment the hammers would be spaced apart by the desired distance between print characters. A line printer of this nature would include a plurality of similar type printing hammers, one for each printed character in the line.

It is anticipated that the teachings herein will produce an electrostatic clutch operated printer having a flight or firing time of approximately 200 microseconds, which is considered in the present state of the art to be a very fast printer.

In one embodiment of the present invention which was constructed and tested, a 1.5 inch diameter aluminum drum having a semiconductive coating thereon was rotated at 120 rpm, thereby producing a drum surface speed of 9.4 inches per second. A 0.002 inch by 0.100 inch steel band was wrapped 180° around the drum circumference. The actuating voltage pulse was 150 volts, having a pulsewidth of 4.5 milliseconds. In operation, the band return speed was slightly over 20 inches per second.

While several embodiments and variations thereof have been described in detail herein, it should be apparent that the teachings and disclosure of the present invention will suggest many other embodiments and variations to those skilled in this art.

What is claimed is:

1. A printing mechanism, comprising:

a. an electrostatic clutch assembly, including a rotatively mounted semiconductive drum, and a conductive band wrapped around the periphery of said drum such that the application of a voltage pulse across said drum and band generates an electrostatic force therebetween, and means for rotating said drum;

b. a printing hammer rotationally mounted on a hammer shaft, and having a first arm extending from said hammer shaft and having a hammer head, said hammer head causing a printing operation during rotational movement of the printing hammer about said shaft in a first direction, said printing hammer also having a second arm extending from said hammer shaft in a direction substantially opposite to that of said first arm, said second arm defining an elongated slot along its length, and a pin being mounted in said slot and further being coupled to said band for movement therewith; and c. a spring means for actuating said printing hammer, said spring means being mechanically coupled to said band through said printing hammer which is pulled to a cocked position, against the compressive action of said spring, by said band during the application of a voltage pulse across said electrostatic clutch while said drum is rotating, said printing hammer being actuated by the cocked spring at the termination of the voltage pulse which releases the spring, and said spring means compressively bearing against said first arm during rotation of said first arm in a direction counter to said first direction.

2. A printing mechanism as claimed in claim 1, including a plurality of printing hammers mounted side by side along said shaft with each printing hammer having a separate band and spring.

* * * * *